US006643962B1

(12) United States Patent
Panec et al.

(10) Patent No.: US 6,643,962 B1
(45) Date of Patent: Nov. 11, 2003

(54) CARD WITH POP-OUT OBJECT AND DISPLAY SYSTEM

(75) Inventors: Don J. Panec, South San Francisco, CA (US); Jim Hybiske, Foster City, CA (US); Arne Lang-Ree, Los Gatos, CA (US)

(73) Assignee: Treasure Bay, LLC, South San Francisco, CA (US)

( * ) Notice: Subject to any disclaimer, the term of this patent is extended or adjusted under 35 U.S.C. 154(b) by 0 days.

(21) Appl. No.: 10/177,938

(22) Filed: Jun. 19, 2002

Related U.S. Application Data

(60) Provisional application No. 60/336,974, filed on Nov. 7, 2001.

(51) Int. Cl.[7] ..... G09F 1/08
(52) U.S. Cl. ..... 40/539; 40/124.09; 40/124.19
(58) Field of Search ..... 40/538, 539, 124.16, 40/124.09, 754, 124.19

(56) References Cited

U.S. PATENT DOCUMENTS

| | | | | | |
|---|---|---|---|---|---|
| 2,074,420 | A | * | 3/1937 | Otis | 40/539 |
| 2,472,166 | A | * | 6/1949 | Mathewson | 40/124.16 |
| 2,777,231 | A | | 1/1957 | Bollin | |
| 4,062,138 | A | | 12/1977 | Warenback | |
| 5,010,669 | A | * | 4/1991 | Moran | 40/539 |
| 5,157,852 | A | | 10/1992 | Patrou et al. | |
| 5,259,133 | A | | 11/1993 | Burtch | |
| 5,303,668 | A | * | 4/1994 | Huang | 40/539 |
| 5,317,823 | A | * | 6/1994 | Brunt, II | 40/539 |
| 5,421,583 | A | | 6/1995 | Gluck | |
| 5,441,778 | A | | 8/1995 | Gilbreath et al. | |
| 5,711,101 | A | * | 1/1998 | Mueller et al. | 40/124.16 |
| 5,758,438 | A | | 6/1998 | Crowell | |
| 6,050,604 | A | | 4/2000 | Ossiatzky | |
| 6,142,532 | A | | 11/2000 | Gluck | |
| 6,152,298 | A | | 11/2000 | Dods | |
| 6,575,803 | B1 | * | 6/2003 | Liu | 40/539 |

* cited by examiner

*Primary Examiner*—Gary Hoge
(74) *Attorney, Agent, or Firm*—Jung-hua Kuo

(57) ABSTRACT

A card with pop-out object and display system is disclosed. The display card generally comprises a base having a non-display surface and an opposing display surface and comprising a platform portion disposed between at least two support portions for supporting the platform portion when the display card is in a display configuration, and at least two flaps securable to the non-display surface of the base when the display card is in a generally flat, storage configuration and securable to the display surface when the card is in the display configuration, wherein the non-display surface is generally hidden from view when the display card is in the display configuration. The display card typically further includes an object and an object housing attached to the non-display surface of the base. The object housing defines an opening for removably storing the object therein. The base serves as a backing to the object when the object is stored in the object housing. In addition, the platform portion secures and displays the object thereon such that the opening defined in the object housing is generally hidden from view when the display card is in the display configuration.

28 Claims, 4 Drawing Sheets

20
22
24
26
28
30
32
34
36
38
41
42
44
46
48
50
52
54
58

CARD WITH POP-OUT OBJECT AND DISPLAY SYSTEM

CROSS REFERENCE TO RELATED APPLICATIONS

This application claims priority to U.S. Provisional Patent Application Ser. No. 60/336,974, entitled "Card with Pop-out Object and Display System," filed Nov. 7, 2001, the entirety of which is incorporated herein by reference.

BACKGROUND OF THE INVENTION

1. Field of the Invention

The present invention relates generally to a card display system. More specifically, a card with pop-out object and display system is disclosed.

2. Description of Related Art

Traditional postcards, greeting cards, display cards, and trading cards are flat, i.e., two dimensional. For example, a typical trading card, such as one featuring a baseball, hockey, football, or basketball player, contains a photograph of a professional athlete along with biographic and sports statistics information for that athlete. Trading cards are very popular particularly with younger sports fans and are often traded amongst the sports fans.

Pop-up cards and books are known and are three dimensional. An example of a pop-up card or book includes a cut out of an object such as one containing an image of a person or an animal. The object is attached to another page, such as a backing page, of the card or book. When the card or book is opened, the cut out object pops out of, i.e., is positioned above, the page in a three dimensional manner.

As another example, a card stock page has a die cut outline around a portion of the perimeter of an object such as one containing an image of a person or an animal such that the object may be partially separated from the card stock page along the die cut outline. The card stock page may further include tabs and fold lines such that the sheet may be folded along the fold lines and secured with the tabs to form a stand in which the partially separated image stands separate from and above the remainder of the card stock page. An example of such a pop up card is described in U.S. Pat. No. 6,050,604. As is evident, when viewed from a back side of the object, the stand is shaped with an outline of the separated portion of the object.

Thus, a conventional three dimensional pop up card does not form an object displayed in a stand in a sleek and aesthetically pleasing manner as viewed from various directions.

SUMMARY OF THE INVENTION

A card with pop-out object and display system is disclosed. It should be appreciated that the present invention can be implemented in numerous ways, including as a process, an apparatus, a system, a device, or a method. Several inventive embodiments of the present invention are described below.

The display card generally comprises a base having a non-display surface and an opposing display surface and comprising at least two support portions and a platform portion disposed between the support portions for supporting the platform portion when the display card is in a display configuration, and at least one flap securable to the non-display surface of the base when the display card is in a generally flat, storage configuration and securable to the display surface when the card is in the display configuration, wherein the non-display surface is generally hidden from view when the display card is in the display configuration.

The display card typically further includes an object and an object housing integrally attached to the non-display surface of the base. The object housing may be integral to the base, i.e., one single component. The object housing defines an opening for removably storing the object therein. The base serves as a backing to the object when the object is stored in the object housing. In addition, the platform portion secures and displays the object thereon such that the opening defined in the object housing is generally hidden from view when the display card is in the display configuration.

The object may include a display mechanism such as tabs and the base platform portion may define corresponding apertures into which the tabs may be inserted and secured for display of the object on the platform portion. The base optionally defines a hole open to and smaller than the opening defined in the object housing which may facilitate removal of the object from the object housing.

The display portion is disposed between the support portions and the flaps are preferably disposed on each side of the display portion. Each flap may define pins configured to be received by and secured into corresponding indentations defined in the base or the object housing when the card is in the storage configuration and into corresponding cavities defined in the support portions when the card is in the display configuration. The pins and the corresponding indentations may have a generally circular or semicircular cross-sectional shape. In addition, each pin and corresponding indentation may define an overhang to further facilitate snapping and hooking the pin into the corresponding indentation.

The base and the object housing may provide fold lines such that each of the support portions is foldable along a fold line relative to the display portion. In particular, the support portions may be foldable along the fold lines toward the object housing or the non-display surface of the display card to convert the display card from the storage configuration to the display configuration. Each flap may also be attached to the card via a fold line such that the flap is foldable in a first direction toward the object housing or the non-display surface of the card to be secured in the storage position and foldable in a second direction opposite the first direction toward the display surface of the card to be secured in the display position.

These and other features and advantages of the present invention will be presented in more detail in the following detailed description and the accompanying figures which illustrate by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which.

DESCRIPTION OF SPECIFIC EMBODIMENTS

A card with pop-out object and display system is disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein. For purpose of clarity, details relating to technical material that is known in the technical fields related to the invention have not been described in detail so as not to unnecessarily obscure the present invention.

Figure 1:
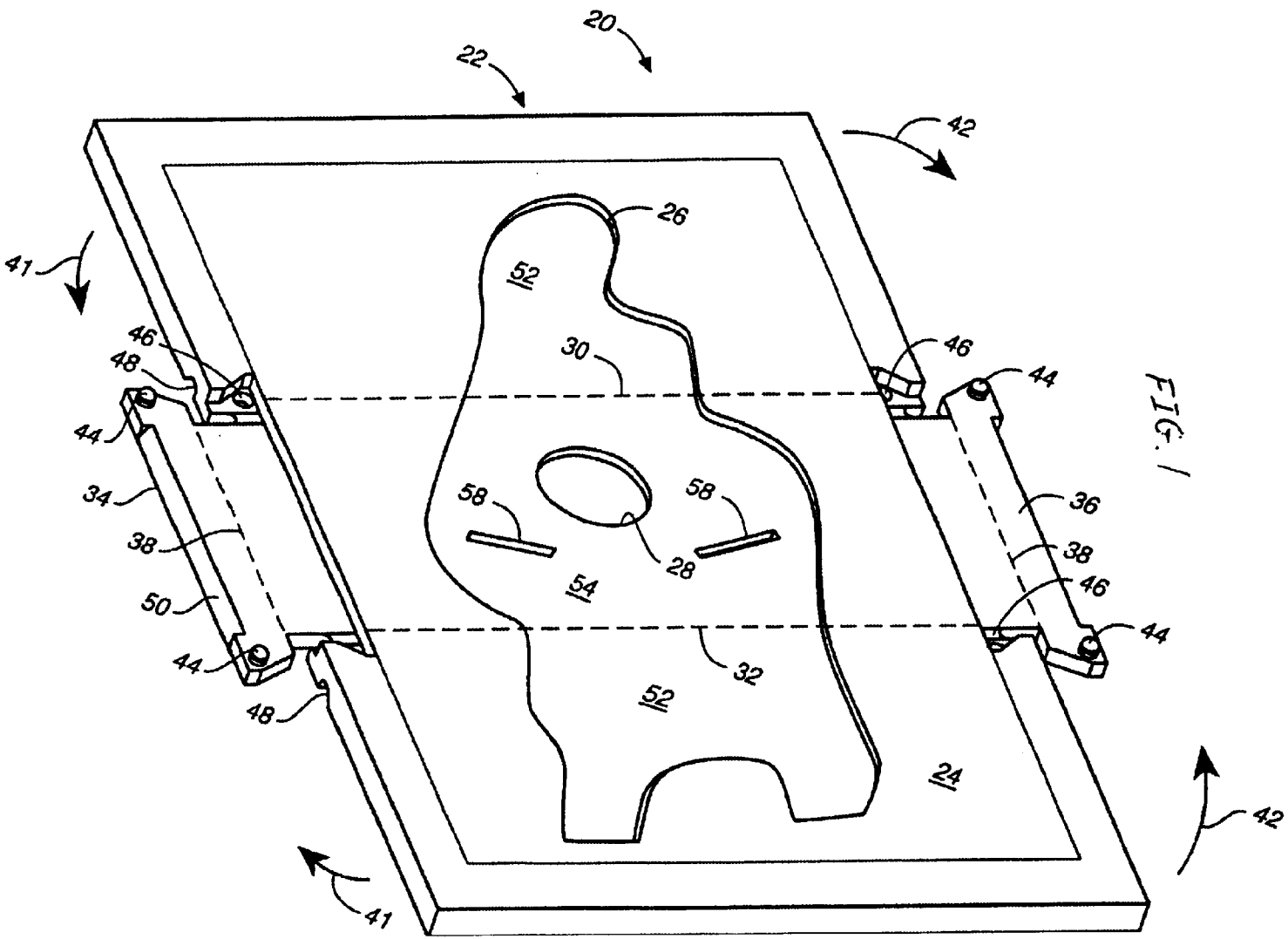
FIG. 1 is a perspective view of a card and display system shown without a pop-out object according to one preferred embodiment.
Figure 2:
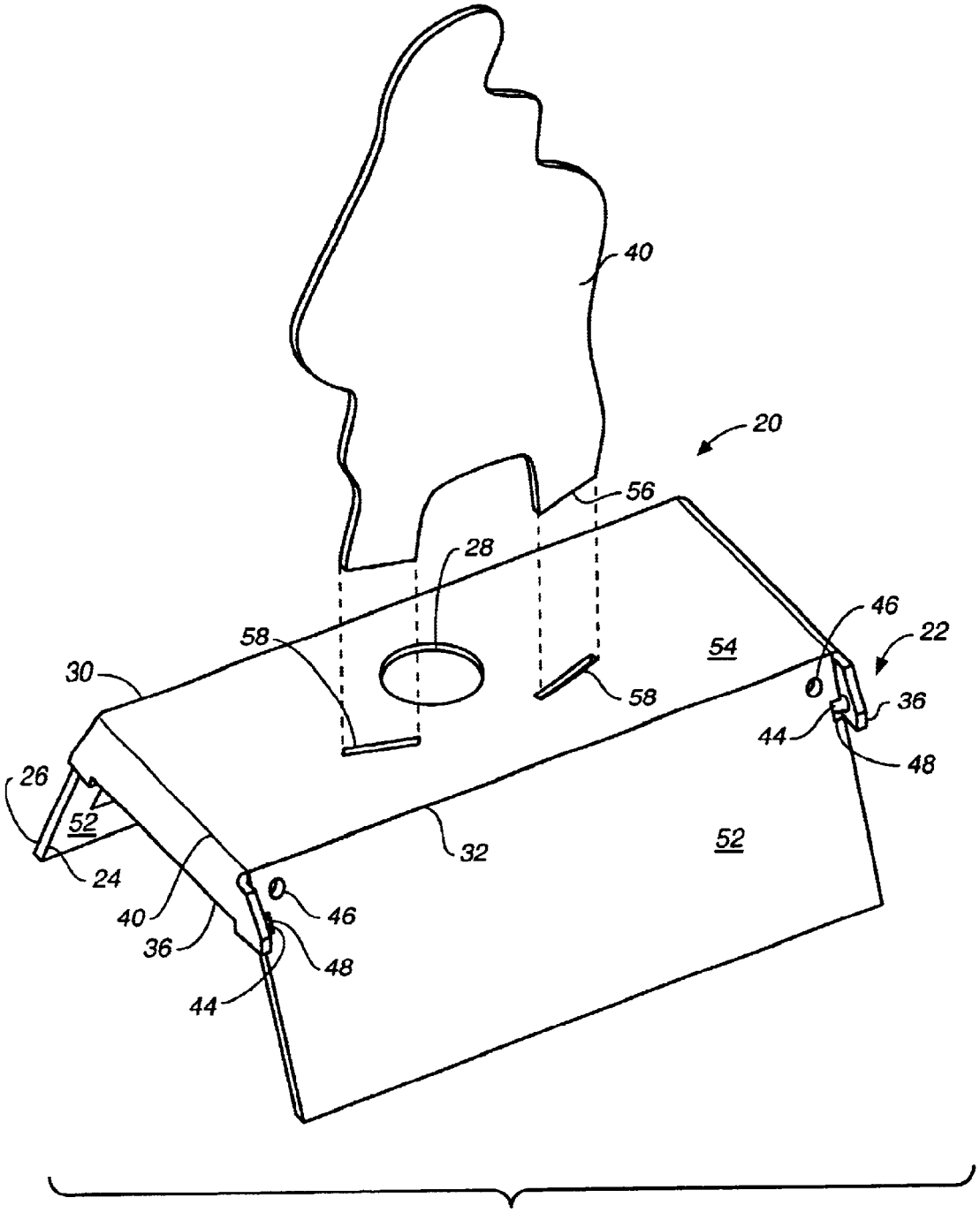
FIG. 2 is a perspective view of the card and display system of FIG. 1 shown in a display configuration along with a popped-out object to be displayed.

FIG. 1 is a perspective view of a card and display system 20 shown without a pop-out object according to one preferred embodiment. FIG. 2 is a perspective view of the card and display system 20 of FIG. 1 shown in a display configuration and with a partial perspective view of the pop-out object to be displayed.

As shown, the card and display system 20 comprises a base 22, an object housing 24, and an object 40 (shown only in FIG. 2) that may be housed within the object housing 24 and on top of the base 22 for storage and is removable from the system 20 for display. The base 22 is typically thicker along the periphery and defines a shape that matches that of the object housing 24 so as to receive the object housing 24 therein. The object housing 24 generally extends to the inner periphery of the base 22 and is preferably integrally and permanently attached thereto. Although the base 22 and the object housing 24 are generally described as separate components herein, it is noted that the base 22 and the object housing 24 may be a single integral component rather than separated components.

The object housing 24 defines an opening 26 for receiving and storing the object 40 therein. The object 40 is stored on top of the base 22 and thus the base 22 serves as a backing to the object 40 when it is stored in the system 20. The object 40 is preferably tight-fitted into the object housing 24. An opening 28 may be provided which may facilitate removal of the object 40 from the base 22. In a storage configuration shown in FIG. 1, the base 22, the object housing 24 along with the object 40 to be stored may generally form a smooth level surface. Alternatively, the object 40 to be stored and optionally the object housing 24 may be slightly recessed into the base 22.

Two flaps 34, 36 are typically provided on opposing edges of the system 20. The flaps 34, 36 are hinged to the base 22 such as along flap fold lines 38. The flap fold lines 38 may be living hinges formed in the flaps 34, 36. In particular, the flaps 34, 36 are typically integrally formed with the base 22 of a plastic material that has a thinning of the plastic material along the fold lines 38 to thereby create and define the living hinges. When the base 22 is in a flat or storage configuration (as shown in FIG. 1), the flaps 34, 36 may facilitate in maintaining the base 22 in a flat position when the flaps are folded in toward the base 22.

Each flap preferably can be secured to the base 22 in both the flat storage or non-angled configuration as shown in FIG. 1 as well as in a display configuration as shown in FIG. 2. For example, each flap preferably includes a pair of pins or plugs 44 that correspond to and mate with indentations 46 defined in the base 22 when the base 22 is in the flat configuration and to cavities 48 defined on a side of the base 22 when the base 22 is in the display configuration. As shown, the pins or plus 44 may have a generally circular cross-sectional shape or any other suitable shape.

The base 22 and the object housing 24 preferably includes two fold lines 30, 32 or is otherwise foldable along the fold lines 30, 32. For example, the fold lines 30, 32 may be comprised of living hinges formed in the base 22 where the base is made of any suitable plastic material and of card stock fold lines in the object housing 24 where the object housing 24 is made of a card stock, including a laminated card stock.

The base 22 and the object housing 24 may first be folded slightly along the fold lines 30, 32 in direction of arrows 41 to facilitate removal of the object 40 from the object housing 24 and to facilitate releasing of the flaps 34, 36 from the base by separating the pins 44 from the corresponding indentations 46. The object 40 may also be removed from the object housing 24 in any other suitable manner.

After the object 40 is removed from the object housing 24, the base 22 and the object housing 24 may then be folded along the fold lines 30, 32 in direction of arrows 42 to form a display platform portion 54 for displaying the object 40 thereon (as shown in FIG. 2), i.e., the display configuration. In particular, folding the base 22 divides the base 22 into two support portions 52 that support the display platform portion 54.

As is evident, the base 22 has a display surface and an opposing non-display surface, the display surface being the surface that is generally visible when the card system 20 is in the display position as shown in FIG. 2. The object housing 24 is attached to the non-display surface of the base 22 and the object housing 24 is generally not visible such that the opening 26 is generally hidden from view when the card system 20 is in the display position as shown in FIG. 2.

Preferably, only the base 22 and the object housing 24 provide the fold lines 30, 32 while the object itself generally does not provide any fold lines so as to allow the object 40 to be easily displayed in a generally upright position when the card system 20 is in a display configuration. In addition, the object 40 is sleeker and more aesthetically pleasing without visually distracting fold lines.

In addition, the fold lines 30, 32 between the support portions 52 and the display platform portion 54 preferably have some shape memory such that when the card system 20 is in the display configuration as shown in FIG. 2, the fold lines 30, 32 have a natural tendency toward having the support portions 52 being flat relative to the display portion 54 as in the storage configuration shown in FIG. 1. That natural tendency of the fold lines 30, 32 facilitates in securing the pins 44 of the flaps 34, 36 in the cavities 48 defined in four locations on the sides of the base 22 and thus facilitates in maintaining the card system 20 in the display configuration.

Similarly, fold lines 38 corresponding to the flaps 34, 36 preferably also have some shape memory such that when the card system 20 is in the display configuration as shown in FIG. 2, the fold lines 38 have a natural tendency toward rotating the flaps 34, 36 away from the support portions 52 when the card system 20 is in the display configuration shown in FIG. 2. That natural tendency thus causes the flaps 34, 36 to automatically rotate away from the support portions 52 when the support portions 52 are slightly squeezed toward each other, such as when the user desires to return the card system 20 to the storage configuration.

Figure 3:
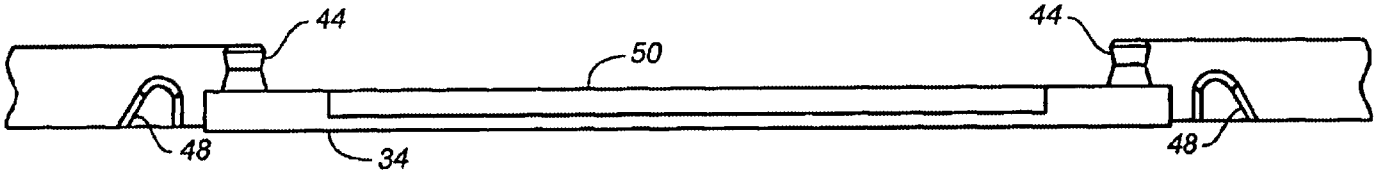
FIG. 3 is a partial side view of the base of the card and display system of FIG. 1 in more detail.
Figure 4:
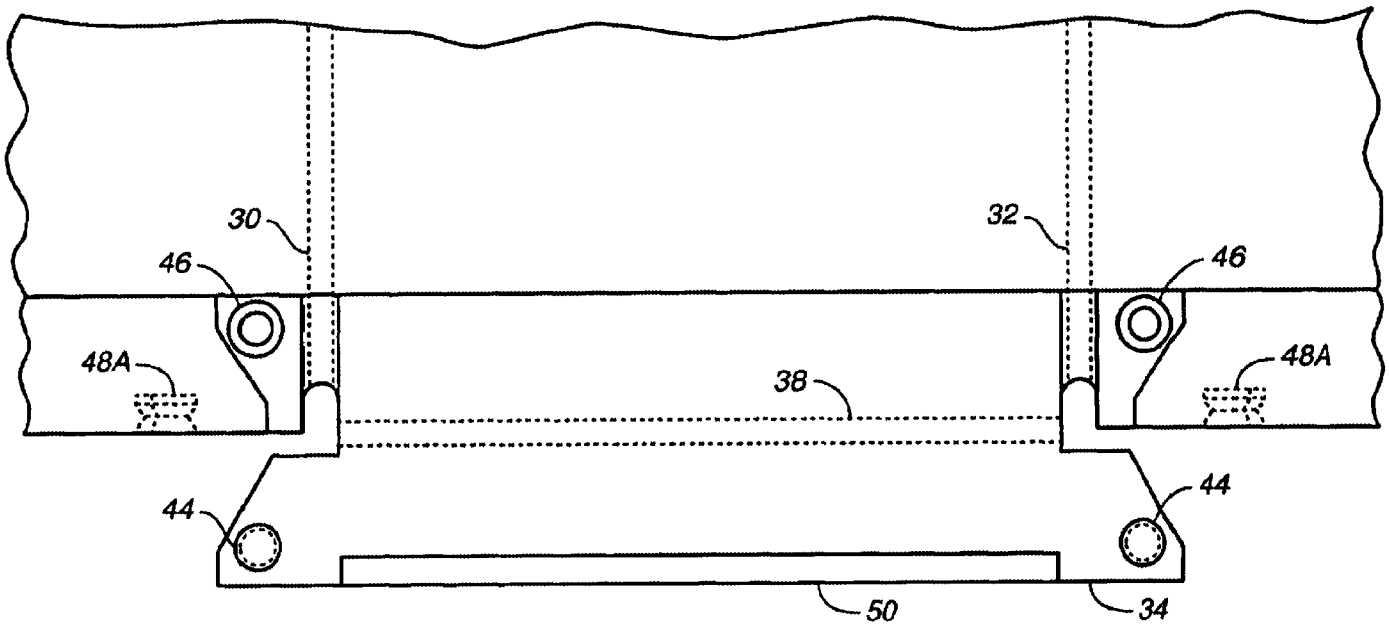
FIG. 4 is a partial top view of the base of the card and display system of FIG. 1 in more detail.

A more detailed view of the flaps 34, 36 and their associated fastening mechanisms are shown in FIGS. 3 and 4. In particular, FIG. 3 is a partial side view of the base 22 of the card and display system of FIG. 1 in more detail. In addition, FIG. 4 is a partial top view of the base 22 of the card and display system of FIG. 1 in more detail. As shown, each of plugs 44 is preferably shaped in such a way so as to securely mate with the corresponding indentation 46 and cavity 48. For example, the plug 44 may be generally cylindrical and flare out on both ends from a middle portion having a smaller diameter. Correspondingly, the indentation 46 and cavity 48 may be similarly shaped and may be similarly dimensioned or have slightly reduced dimensions so as to receive and secure the corresponding plug therein. In one preferred embodiment, each flap may provide a chamfer 50 to facilitate a user in disengaging the flap from the corresponding indentation 46 and/or cavity 48.

Referring again to FIGS. 1 and 2, the opening 26 defined by the object housing 24 is preferably shaped to receive the object 40. In one preferred embodiment, object housing 24, the object 40, and the flaps 34, 36 form a generally smooth or integrated surface for the card system 20 when the card system 20 is in a storage configuration, i.e., the object housing 24 in the flat position, the object 40 stored in the object house 24, and the flaps 34, 36 in the closed position.

The object 40 preferably defines tabs 56 that may be inserted into apertures 58 provided in the display platform portion 54 of the base 22. The tabs 56 facilitate display of the object 40 on the display platform portion 54 of the base 22. In addition, apertures 58 are preferably disposed at an angle relative to each other, i.e., non-aligned, to facilitate securing of the object 40 to the base 22 for display.

The system 20 may be manufactured from a single piece of stock or from any suitable number of pieces. The stock may be of any suitable material such as plastic, plastic laminate, card stock such as cardboard, and/or laminated card stock. In the case of plastic, suitable plastic materials include polypropylene and polyethylene. In a preferred embodiment, the base is made from a plastic material, typically polypropylene or polyethylene, and the object and the object housing are made from a card stock, typically covered in a layer of plastic laminate on at least the exposed surfaces to increase its durability, i.e., maintain its structural integrity thereby lengthening its useful life. As the object is exposed on generally all surfaces when displayed, the object is preferably covered in a layer of plastic laminate on all surfaces.

Figure 5:
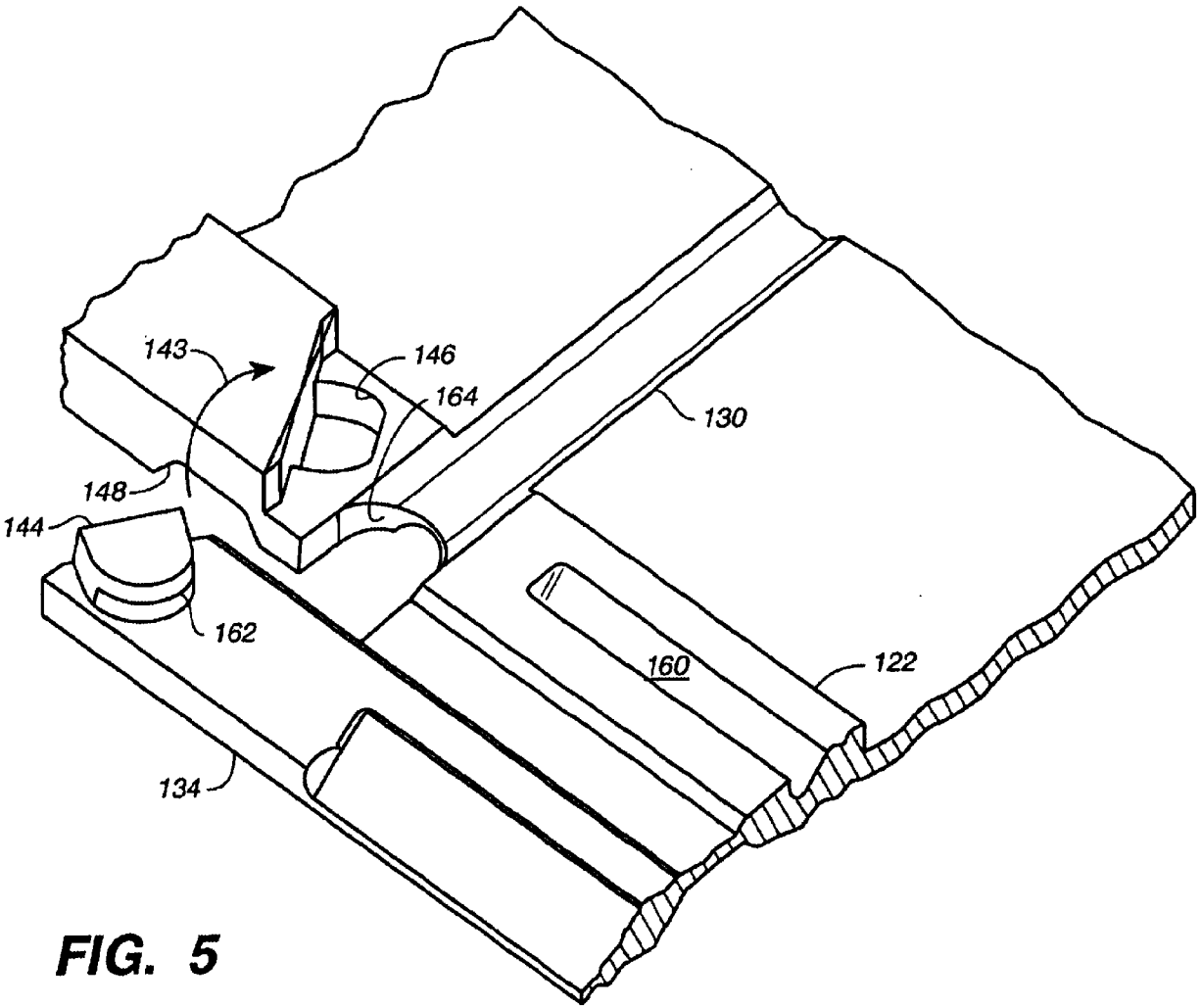
FIG. 5 is a partial top perspective view of an alternative configuration of a flap and its associated fastening mechanisms.

An alternative configuration of a flap and its associated fastening mechanisms are shown in FIG. 5. In particular, FIG. 5 is a partial top perspective view of an alternative flap 134 and its associated fastening mechanisms. Features for the embodiment of FIG. 5 that are similar to those shown in FIGS. 1–4 and described above are not repeated for purposes of clarity only.

As shown, plugs or pins 144 have a semicircular cross-sectional shape and indentations or orifices 146 are similarly shaped and sized for receiving and securing the pins 144 therein when the card and display system is in a flat or storage configuration by directing the flap 134 in a direction as shown by arrow 143. The pin 144 may provide a lip or overhang 162 to facilitate securing of the pin 144 to the corresponding orifice 146. Specifically, providing the lip 162 on the pin 144 allows the pin 144 to be snapped and hooked into the orifice 146 to be secured therein.

The base 122 also defines cavities 148 configured to receive the semicircular pins 144 when the card and display system is in a display configuration. It is noted that use of a semicircular cross-sectional shape for the pin 144 increases the diameter of the pin 144 and thus the amount of the overhang 162, resulting in a corresponding increase in the hook between the pin 144 and the corresponding orifice 146 as well as the corresponding cavity 148.

The portions of the base 122 that is overlapped by the flaps 134 when the card and display system is in a storage configuration may optionally define channels 160 for increased structural integrity. In addition, a gap 164 may be defined in the base 122 at either end of the living hinge as a relief for the living hinge 130.

While the preferred embodiments of the present invention are described and illustrated herein, it will be appreciated that they are merely illustrative and that modifications can be made to these embodiments without departing from the spirit and scope of the invention. Thus, the invention is intended to be defined only in terms of the following claims.

What is claimed is:

1. A card and display system, comprising:

an object;

a base having a housing surface and a display surface;

an object housing integrally attached to the housing surface of the base and defining an opening for removably storing the object therein when the system is in a generally flat storage configuration, the base serving as a backing to the object when the object is stored in the object housing, the integral base and object housing comprising a display portion and a plurality of support portions; and at least one flap securable to at least one of the object housing and the base at a storage position when the system is in the generally flat storage configuration and at a display position when the system is in a display configuration, wherein when the system is in the display configuration, the object is displayed on the display portion and the display surface of the base and the display portion is generally supported by the support portions such that the opening defined in the object housing is generally hidden from view.

2. The card and display system of claim 1, wherein the object includes a display mechanism comprising at least one tab and the display portion of the base defines a corresponding aperture into which the at least one tab is insertable for display of the object on the base display portion.

3. The card and display system of claim 1, wherein the plurality of support portions of the integral base and object housing comprises two support portions and the display portion of the integral base and object housing is disposed between the two support portions.

4. The card and display system of claim 1, wherein the at least one flap comprises two flaps disposed on each side of the display portion of the integral base and object housing.

5. The card and display system of claim 1, wherein the at least one flap comprises two flaps, each flap defining at least two pins configured to be received by and secured into two corresponding indentations defined in one of the object housing and the base when the system is in the storage configuration and to be received by and secured into two corresponding cavities defined in the support portions when the system is in the display configuration.

6. The card and display system of claim 5, wherein each pin and each corresponding indentation has one of a generally circular cross-sectional shape and a generally semicircular cross-sectional shape.

7. The card and display system of claim 5, wherein each pin and each corresponding indentation has a generally semicircular cross-sectional shape, each pin and each corresponding indentation defining an overhang to facilitate snapping and hooking the pin in the corresponding indentation.

8. The card and display system of claim 1, wherein the integral base and object housing comprises at least two display fold lines such that each of the support portions is foldable along one of the display fold lines relative to the display portion of the integral base and object housing.

9. The card and display system of claim 8, wherein each of the display fold lines includes a living hinge.

10. The card and display system of claim 8, wherein the support portions of the integral base and object housing are foldable along the display fold lines toward the display portion of the object housing to convert the system from the storage configuration to the display configuration.

11. The card and display system of claim 8, wherein each of the at least one flap is attached to one of the object housing and the base via a flap fold line such that the flap is foldable in a first direction along the flap fold line toward the object housing to be secured in the storage position and foldable in a second direction along the flap fold line opposite the first direction toward the display surface of the base to be secured in the display position.

12. The card and display system of claim 11, wherein the base comprises a plastic material and the object housing comprises a card stock material and each of the display fold lines and the flap fold lines includes a living hinge formed in the base and a card stock fold line defined in the object housing.

13. The card and display system of claim 1, wherein each of the at least one flap is attached to one of the object housing and the base via a fold line such that the flap is foldable in a first direction toward the object housing to be secured in the storage position and foldable in a second direction opposite the first direction toward the display surface of the base to be secured in the display position.

14. The card and display system of claim 1, wherein each of the object housing and the base comprises at least one of plastic, polypropylene, polyethylene, plastic laminate, card stock, cardboard, and laminated card stock.

15. A display card, comprising:

a base having a non-display surface and a display surface opposing the nondisplay surface, the base comprises a platform portion disposed between at least two support portions for supporting the platform portion when the display card is in a display configuration; and at least two flaps securable to the non-display surface of the base at a storage position when the display card is in a generally flat, storage configuration and securable to the display surface at a display position when the display card is in the display configuration, wherein when the display card is in the display configuration the display portion is generally supported by the support portions and the non-display surface is generally hidden from view.

16. The display card of claim 15, wherein the at least two flaps are disposed on each side of the platform portion of the base.

17. The display card of claim 15, wherein each flap defines at least two pins configured to be received by and secured into two corresponding indentations defined in the base when the display card is in the storage configuration and to be received by and secured into two corresponding cavities defined in the support portions of the base when the display card is in the display configuration.

18. The display card of claim 17, wherein each pin and each corresponding indentation has one of a generally circular cross-sectional shape and a generally semicircular cross-sectional shape.

19. The display card of claim 17, wherein each pin and each corresponding indentation has a generally semicircular cross-sectional shape, each pin and each corresponding indentation defining an overhang to facilitate snapping and hooking the pin in the corresponding indentation.

20. The display card of claim 15, wherein the base comprises at least two display fold lines such that each of the support portions is foldable along one of the display fold lines relative to the platform portion of the base.

21. The display card of claim 20, wherein each of the display fold lines includes a living hinge.

22. The display card of claim 20, wherein the support portions of the base are foldable along the display fold lines toward the platform portion to convert the display card from the storage configuration to the display configuration.

23. The display card of claim 15, wherein each of the at least two flaps is attached to the base via a flap fold line such that the flap is foldable in a first direction along the flap fold line toward the non-display surface of the platform portion of the base to be secured in the storage position and foldable in a second direction along the flap fold line opposite the first direction toward the display surface of the base to be secured in the display position.

24. The display card of claim 23, wherein the base comprises a plastic material and each of the display fold lines and the flap fold lines includes a living hinge formed in the plastic material of the base.

25. The display card of claim 15, wherein each of the at least two flaps is attached to one of the object housing and the base via a fold line such that the flap is foldable in a first direction toward the object housing to be secured in the storage position and foldable in a second direction opposite the first direction toward the display surface of the base to be secured in the display position.

26. The display card of claim 15, wherein the base comprises at least one of plastic, polypropylene, polyethylene, plastic laminate, card stock, cardboard, and laminated card stock.

27. The display card of claim 15, further comprising:

an object; and an object housing attached to the non-display surface of the base, the object housing defining an opening for removably storing the object therein, the base serving as a backing to the object when the object is stored in the object housing, the opening being generally hidden from view when viewed from the display surface of the base, the platform portion being for securing and displaying the object thereon such that the opening defined in the object housing is generally hidden from view when the display card is in the display configuration.

28. The display card of claim 27, wherein the object includes a display mechanism comprising at least one tab and the platform portion of the base defines a corresponding aperture into which the at least one tab is insertable for display of the object on the platform portion.

* * * * *